US006290122B1

(12) United States Patent
Correll

(10) Patent No.: US 6,290,122 B1
(45) Date of Patent: Sep. 18, 2001

(54) VERSATILE PIZZA CARTON

(76) Inventor: John D. Correll, 8459 Holly Dr., Canton, MI (US) 48187-4237

( * ) Notice: Subject to any disclaimer, the term of this patent is extended or adjusted under 35 U.S.C. 154(b) by 0 days.

(21) Appl. No.: 09/551,245

(22) Filed: Apr. 17, 2000

Related U.S. Application Data

(63) Continuation-in-part of application No. 09/394,784, filed on Sep. 13, 1999, now Pat. No. 6,206,277, and a continuation-in-part of application No. 09/378,656, filed on Aug. 20, 1999, now Pat. No. 6,196,448, and a continuation-in-part of application No. 09/200,684, filed on Nov. 27, 1998, now Pat. No. 6,065,669.

(51) Int. Cl.[7] ..... B65D 21/032

(52) U.S. Cl. ..... 229/104; 206/511; 206/512; 229/120; 229/169; 229/172; 229/178; 229/906; 229/915

(58) Field of Search ..... 229/104, 120, 229/169, 172, 178, 902, 906, 915, 916, 918; 206/509, 511, 512

(56) References Cited

U.S. PATENT DOCUMENTS

| | | | | |
|---|---|---|---|---|
| 1,471,478 | * | 10/1923 | Feigelman | 229/172 |
| 2,056,969 | * | 10/1936 | Inman | 229/104 |
| 2,733,112 | * | 1/1956 | Dunham | 206/509 |
| 3,107,039 | * | 10/1963 | Painter | 229/104 |
| 3,163,344 | * | 12/1964 | Tunick | 229/916 |
| 3,447,672 | * | 6/1969 | Bailey et al. | 229/104 |
| 4,613,045 | * | 9/1986 | Watson | 229/104 |
| 4,984,734 | * | 1/1991 | Zion et al. | 206/509 |
| 5,209,392 | * | 5/1993 | Anatro | 229/906.2 |
| 5,253,800 | | 10/1993 | France | 229/109 |
| 5,381,949 | | 1/1995 | Correll | 229/198.2 |
| 5,549,241 | | 8/1996 | Correll | 229/120.01 |
| 5,704,483 | * | 1/1998 | Groh | 229/104 |
| 5,752,651 | | 5/1998 | Correll | 229/150 |
| 5,806,755 | | 9/1998 | Correll | 229/110 |
| 5,833,130 | * | 11/1998 | Correll | 229/104 |
| 5,881,948 | | 3/1999 | Correll | 229/123 |
| 5,961,035 | * | 10/1999 | Correll | 229/104 |
| 6,065,699 | * | 5/2000 | Correll | 229/906 |
| 6,196,448 | * | 3/2001 | Correll | 229/902 |
| 6,206,277 | * | 3/2001 | Correll | 229/104 |

* cited by examiner

*Primary Examiner*—Gary E. Elkins

(57) ABSTRACT

A wall-engageable pizza carton folded into a non-wall-engaged format and which (a) has thermal-legs for holding the bottom of the box above a table top, (b) has an improved hole-covering flap that can function as an inner panel interlock means, and (c) can be stacked in a level stack with other cartons even though it has thermal-legs and the cover front flap is projecting forward.

30 Claims, 5 Drawing Sheets

FIG-2
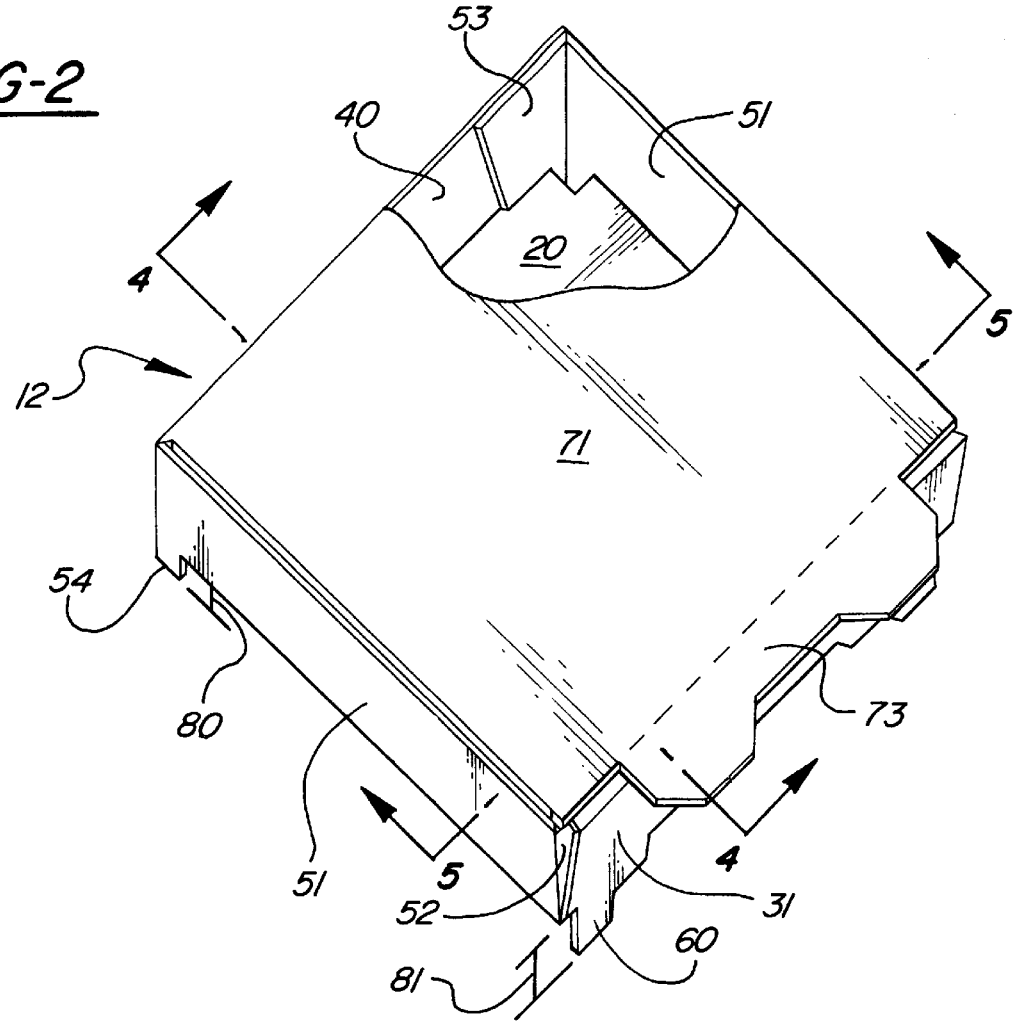
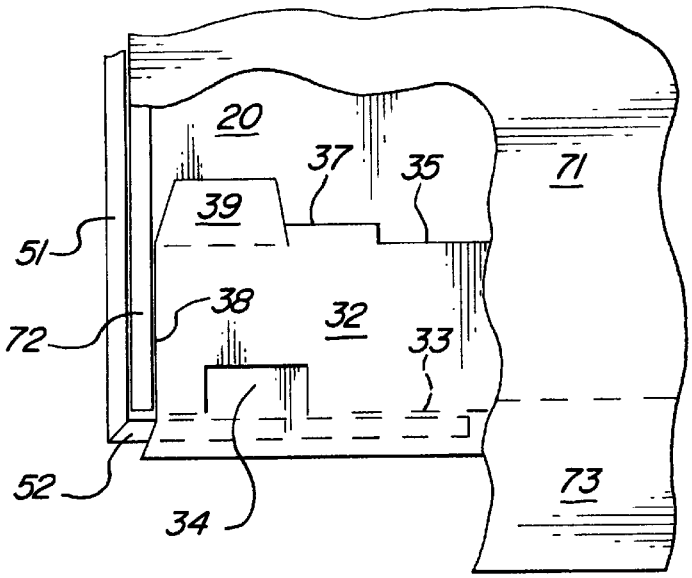
FIG-3

FIG-9
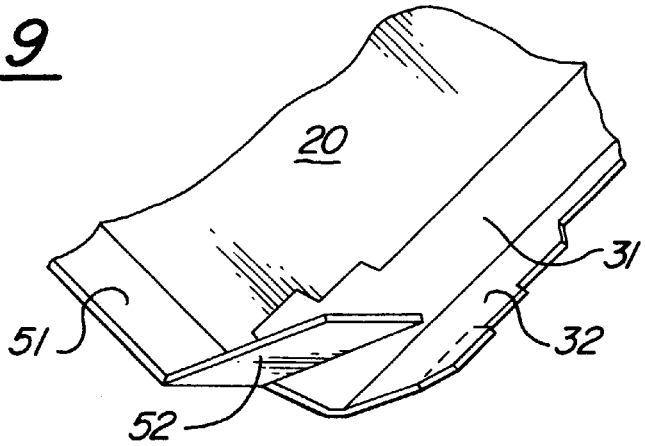
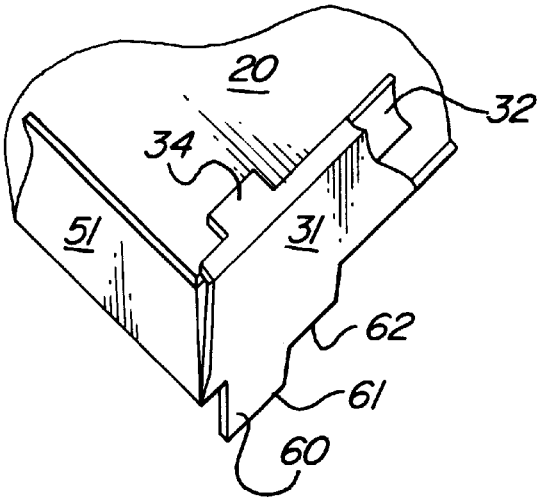
FIG-10
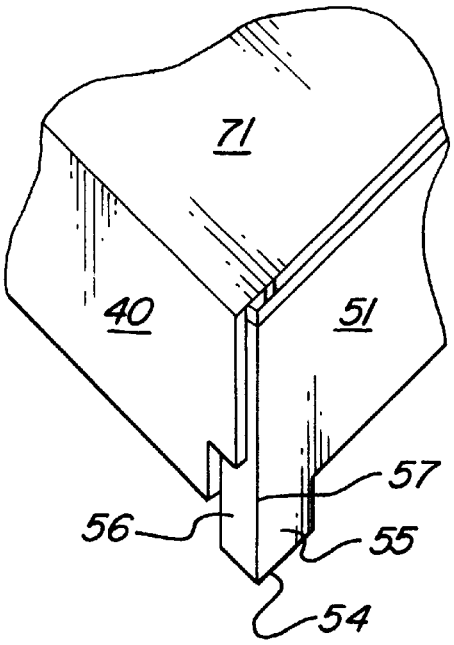
FIG-15

VERSATILE PIZZA CARTON

CROSS-REFERENCES TO RELATED APPLICATIONS

This is a continuation-in-part of application Ser. No. 09/394,784, entitled "Quality-enhancing Pizza Carton," filed Sep. 13, 1999, now U.S. Pat. No. 6,206,277, and of application Ser. No. 09/378,656, entitled "Heat-retaining Food Carton," filed Aug. 20, 1999, now U.S. Pat. No. 6,196,448, and of application Ser. No. 09/200,684, entitled "Slanting-wall Pizza Box," filed Nov. 27, 1998, now U.S. Pat. No. 6,065,669.

FIELD OF THE INVENTION

This invention relates to cartons made of foldable material and, in particular, to paperboard cartons for food products such as pizza.

DESCRIPTION OF THE PRIOR ART

Each year millions of hot pizzas are sold for delivery and carry-out. The physical and perceived quality of those pizzas are, in large part, determined by the type of packaging used for transporting them.

The most prevalent prior art packaging for pizza is the standard square corrugated pizza box with the double-panel front wall, in which corner flaps attached to the front end of the side walls are enclosed between the two panels of the double-panel front wall, thereby engaging the front wall structure with each of the side wall structures.

Problems pertaining to that standard pizza box include:

1) Inability to easily cut the pizza in the box with a rocker knife without deforming the side walls of the box; and
2) Contact of the hot bottom panel of the box with the customer's table top, resulting in loss of heat by conduction from the box bottom into the table top and also condensation build-up on the table.

Pertaining to the first problem, prior art structure can be defined in terms of wall-engaged versus non-wall-engaged cartons. As used herein, a wall-engaged carton is a carton in which at least two wall structures are engaged one to the other. This engagement enables the particular wall structures to remain upright when the carton is in open disposition, or when the cover has been removed or laid back from the top of the carton. An example of a wall-engaged pizza carton would be the standard square pizza box with the double-panel front wall structure. A carton that has wall structures designed for engaging one to another is referred to, herein, as a "wall-engageable carton."

As used herein, a non-wall-engaged carton is a carton in which none of the wall structures have been engaged to one another. This situation results in all of the wall structures being easily pushed into a horizontal position when the carton is in open disposition. Therefore, the distinguishing difference between a wall-engaged and a non-wall-engaged carton is whether the wall structures can be pushed to horizontal disposition when the carton is in open disposition. An example of a non-wall-engaged carton is shown in Correll U.S. Pat. No. 5,752,651 (Matable Blank and Food Carton) granted May 19, 1998.

Both types of cartons have advantages and drawbacks as regards pizza. An advantage of the engaged-wall type of carton is that it has a rigid structure in open disposition. However, because of the upright walls, it has a drawback of being somewhat awkward for loading and cutting a pizza. In addition, it does not allow a pizza to be easily cut in the box using a rocker knife, the preferred cutting tool of many pizza operators.

The non-engaged-wall type of carton, on the other hand, has an advantage of being relatively easy for loading and cutting pizza, but it has a drawback of having floppy walls when the cover is open, which can result in an unappealing carton.

A variation of an engaged-wall carton is shown in Correll U.S. Pat. No. 5,881,948 (Expandable Pizza Box and Method of Use) granted Mar. 16, 1999. The patent discloses an expandable pizza box having side walls that can assume an angled disposition when the box is open. This provides for easier box loading but it still does not allow a pizza to be easily cut in the box with a rocker knife.

Two other variations of an engaged-wall carton are shown in Correll U.S. Pat. No. 5,381,949 (Box) granted Jan. 17, 1995, and Correll U.S. Pat. No. 5,806,755 (Product-protecting Pizza Carton) granted Sep. 15, 1998. These patents each disclose a box with side walls engaged with a front wall. What's unique about these boxes is that the walls can be disengaged after opening the cover. Although this allows for use of a rocker knife, it requires extra time and trouble in disengaging the wall structures.

So there has remained a need for a single pizza carton that combines the advantages of the wall-engaged and non-wall-engaged types of cartons, while eliminating the drawbacks of both. That need has not been solved by the prior art, but is solved by my invention. By solving that need a pizza company can provide a higher-quality delivery/carry-out pizza.

Pertaining to the second problem, that of eliminating contact of the box bottom with the table top, two prior patents of mine—namely, Correll U.S. Pat. No. 5,833,130 (Multi-function Pizza Carton) granted Nov. 10, 1998, and Correll U.S. Pat. No. 5,961,035 (Designer Pizza Box with Enhancements) granted Oct. 5, 1999, each disclose thermal-legs, a means for elevating a box bottom above a table top. The instant invention discloses further inventive structure pertaining to thermal-legs and, in certain aspects, combines that new structure with the structure of those two prior patents to produce enhanced pizza box functionality. A problem not solved by the prior art is how to stack multiple thermal-leg-equipped cartons in a level stack when the cover front flap is projecting forward (to enable easy retrieval of a box from the stack). The instant invention solves that problem.

In addition, France U.S. Pat. No. 5,253,800 granted Oct. 19, 1993, discloses an elevating means for an open-ended, topless corrugated tray. However, France's structure is not adaptable for use in a one-piece, four-sided carton, particularly a carton having the basic type of structure used in the standard pizza box with the double-panel front wall.

Finally, Correll U.S. Pat. No. 5,549,241 (Interlock for Stackable Boxes) granted Aug. 27, 1996, shows a box with tabs projecting downward from the front and rear walls. However, it does not disclose elevating means of the type disclosed in the present invention.

So, the two above-described problems have not been solved by the prior art but are solved by my invention. By solving those problems, a higher quality pizza and superior package can be obtained.

OBJECT AND ADVANTAGES

Accordingly, the object of my invention is a carton that is more functional than a standard square pizza box and does a better job of enhancing the real and perceived quality of delivery/carry-out pizza. More specifically, the object of my invention is a carton that does one or more of the following:

(1) can be formed into a non-wall-engaged format prior to loading the pizza (when pre-folded cartons are stacked up) and, subsequently, can be folded into a wall-engaged format after loading the pizza, (2) provides an improved elevating means for holding the bottom of a loaded box above a table top, and (3) can be stacked in a level stack even though the carton has elevating means and the cover front flap is projecting forward (to allow for easy grabbing of the box from the stack).

The advantage of my invention is enhanced quality of delivery-carry-out pizza and resulting increased customer satisfaction and sales.

Further objects and advantages of the invention will become apparent from consideration of the following detailed description, related drawings, and appended claims.

SUMMARY OF THE INVENTION

My invention is a carton that can incorporate one or more of the following features:

1) Has engageable wall structures that are disposed in a non-engaged format even though the carton is in erected disposition;

2) Has thermal-legs of unique structure;

3) Has a hole-covering flap attached to the inner panel of a double-panel wall, the hole-covering flap performing the dual functions of (a) covering an opening in the bottom of the box and (b) holding the inner panel of the double-panel wall in engaged or upright mode (the opening being typically created from formation of a thermal-leg that's adjacent the double-panel wall);

4) Has a reduced-width cover front flap, thereby enabling multiple thermal-leg-equipped cartons to be stacked relatively level when the cover front flap is projecting forward.

My invention typically would be used for packaging relatively flat food products such as pizza; however, it could take other forms for other purposes, as well.

A complete understanding of the invention can be obtained from the detailed description that follows.

BRIEF DESCRIPTION OF THE DRAWINGS

FIG. 2 is a perspective view of a closed carton formed from the blank.

FIG. 3 is a top view of the left front corner section of the closed carton showing the side wall and front wall structure in non-engaged disposition, the cover panel being partially cut away.

FIG. 9 is an outside perspective view of the left front corner section of an open carton showing the side wall and front wall structure in non-engaged disposition.

FIG. 10 is an outside perspective view of the left front corner section of an open carton showing the side wall and front wall structure in engaged disposition.

FIG. 15 is a perspective view of the left rear corner section of the closed carton of FIG. 2.

LIST OF REFERENCE NUMERALS

Figure 1:
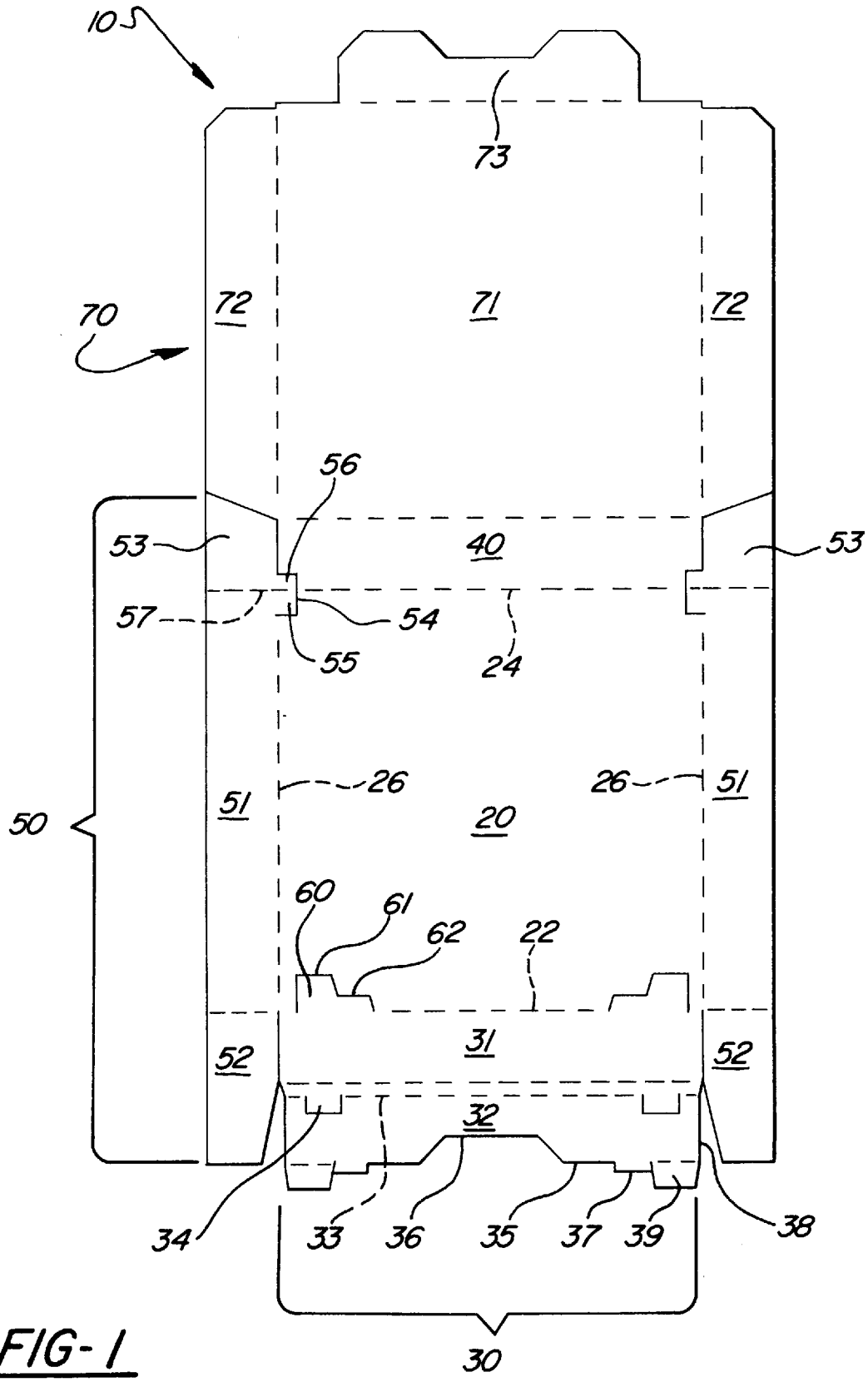
FIG. 1 is a plan view of the blank of the preferred embodiment.

Between drawings, like reference numerals designate corresponding parts.

10 blank of the preferred embodiment
12 carton formed from the blank
14 stack of topside up cartons
16 stack of upside down cartons
20 bottom panel
22 front edge of bottom panel (bottom edge of outer panel
24 rear edge of bottom panel
26 side edge of bottom panel
30 double-panel front wall structure
31 outer panel
32 inner panel
33 parallel fold lines
34 tab
35 outer edge of inner panel
36 inwardly-disposed portion of outer edge
37 interlock portion
38 end edge of inner panel
39 hole-covering flap
40 rear wall
50 side wall structure
51 side wall panel
52 front corner panel
53 rear corner panel
54 thermal-leg
55 first portion of thermal-leg
56 second portion of thermal-leg
60 thermal-leg
61 lower portion of bottom edge of thermal-leg
62 upper portion of bottom edge of thermal-leg
70 cover
71 cover panel
72 cover side flap
73 cover front flap
80 height of rear thermal-leg
81 height of front thermal-leg
88 opening in bottom of the box

DESCRIPTION OF THE PREFERRED EMBODIMENT

Referring now to the drawings, there is illustrated a preferred embodiment of the invention in the format of a one-piece corrugated paperboard blank and, correspondingly, in the format of a pizza carton created from the blank. Although the intended use for the embodiment is as a food carton or, specifically, a pizza carton, it will be appreciated, as the description proceeds, that my invention may be realized in different embodiments and may be used in other applications.

FIG. 1 shows a blank 10 and FIG. 2 shows a carton 12 created from blank 10. Referenced components are labeled in FIG. 1; selected components are labeled in other Figures.

Corresponding parts between drawings share a same reference numeral. It is noted that the invention is bilaterally symmetrical. Therefore, pairs of opposing like components are to be found, with one item of the pair on each side of the carton or blank. For simplicity of labeling, each component pair may be indicated by a numeral on one side of the drawing only. Where this occurs, it is to be understood that the discussion also applies to the corresponding component on the other side, even though that component may not be numerically labeled.

Structure of the Invention

Referring now to blank 10 shown in FIG. 1, there is a bottom panel 20 which has a front edge 22, a rear edge 24, and a pair of opposing side edges 26.

Attached to bottom panel 20 are a double-panel front wall structure 30, a rear wall 40, and a pair of opposing side wall structures 50.

Front wall structure 30 has an outer panel 31 hingedly attached at a bottom edge to bottom panel front edge 22 and an inner panel 32 hingedly linked at a pair of parallel fold lines 33 to a top edge of panel 31. (In the drawings, in addition to indicating the front edge of bottom panel 20, numeral 22 also indicates the bottom edge of outer panel 31.) Projecting from parallel fold lines 33 is a pair of tabs 34 which function as cover anti-shift means. Inner panel 32 has a pair of opposing end edges 38 and an outer edge 35 that has an inwardly-disposed portion 36. Disposed along outer edge 35 are a pair of interlock portions 37 and a pair of hole-covering flaps 39 which are attached to panel 32 at fold lines. Interlock portions 37 and hole-covering flaps 39 both function as inner panel interlock means, which means that they hold inner panel 32 in upright (vertical) position when wall structures 30 and 50 are engaged.

Projecting from the bottom edge of outer panel 31 are a pair of front thermal-legs 60. Each thermal-leg 60 has a bottom edge comprising two major portions: a lower edge portion 61 and an upper edge portion 62. The main object of the thermal-legs is to elevate the bottom panel of a loaded carton above a support surface and, thereby, reduce conductive heat transfer through the box bottom to the support surface. Further discussion of the structure and function of thermal-legs can be found in my U.S. Pat. No. 5,833,130 (Multi-function Pizza Carton) and in my U.S. Pat. No. 5,961,035 (Designer Pizza Box with Enhancements), that discussion being included herein by reference thereto.

Rear wall 40, which is hingedly attached to bottom panel rear edge 24 at a fold line, is a reclinable rear wall, meaning that when the carton cover is opened and laid back rear wall 40 reclines to a position approximately coplanar to bottom panel 20.

Each side wall structure 50 comprises a side wall panel 51 hingedly attached at a fold line to bottom panel side edge 26, a free-swinging front corner panel 52 hingedly attached to a front end of side wall panel 51, and a free-swinging rear corner panel 53 attached to a rear end of side wall panel 51.

Projecting from each side wall structure 50 is a rear thermal-leg 54. Each thermal-leg 54 comprises two portions: a portion 55 which projects downward from side wall panel 51 and a portion 56 which projects downward from rear corner panel 53. The portions are joined at a fold line 57. In the carton format, portions 55, 56 are at an angle to each other.

Figure 11:
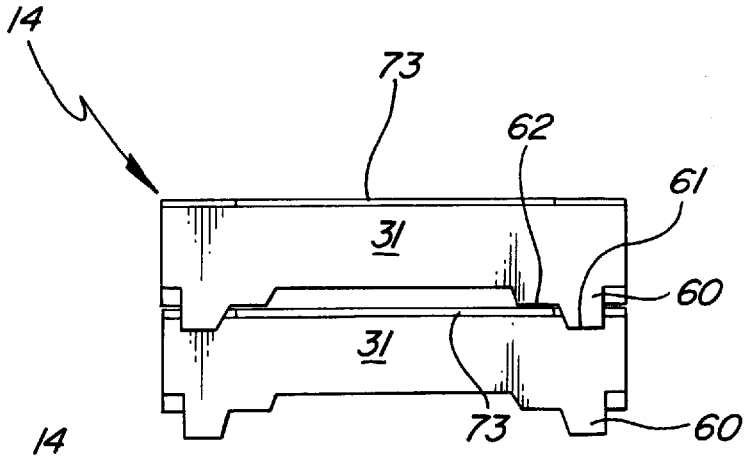
FIG. 11 is a front elevation view of a stack of two topside up cartons.

A cover 70 comprises a cover panel 71 which is hingedly attached to a top edge of rear wall 40 at a fold line, a pair of opposing cover side flaps 72 which are hingedly attached to side edges of cover panel 71 at fold lines, and a cover front flap 73 which is hingedly attached to a front edge of panel 71 at a fold line. Cover front flap 73 is narrower than a conventional cover front flap, thereby allowing the flap to fit between front thermal-legs 60 when multiple cartons are stacked (FIG. 11).

Formats of the Invention

One of the unique aspects of my invention is that the preferred embodiment can be disposed in various formats, including the following seven formats:

1) Blank
2) Closed carton in non-engaged mode
3) Closed carton in engaged mode
4) Open carton in non-engaged mode
5) Open carton in engaged mode
6) Stack of topside up cartons
7) Stack of upside down cartons Format #1, the blank, is the invention in the form of a corrugated board cut and scored into structural components (described in the previous section), ready to be formed into a carton. That format is shown in FIG. 1.

Figure 4:
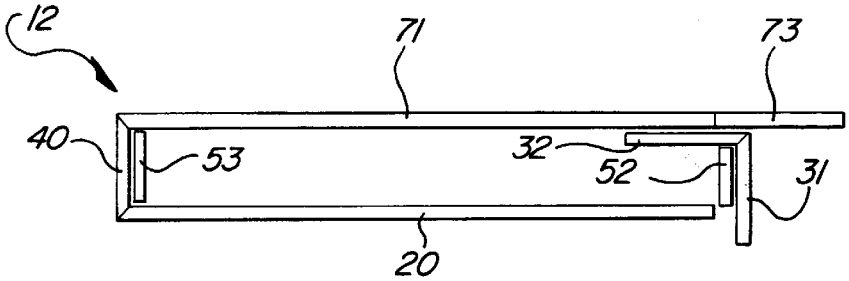
FIG. 4 is a side sectional view of the closed carton in non-engaged mode, taken along line 4—4 of FIG. 2.
Figure 5:
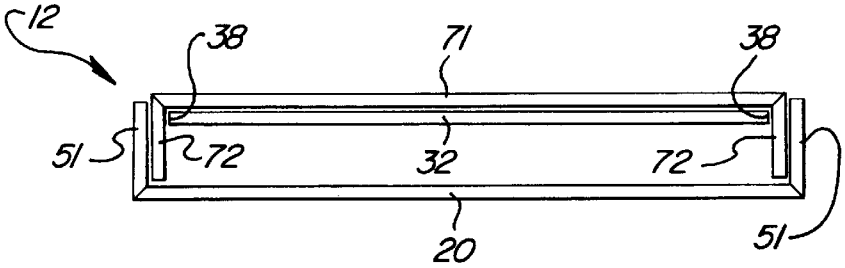
FIG. 5 is a front sectional view of the closed carton in non-engaged mode, taken along line 5—5 of FIG. 2.

Format #2, the closed carton in non-engaged mode, is a carton with the cover in closed disposition and wall structures 30 and 50 in non-engaged disposition. A closed carton 12 is shown in FIG. 2. For wall structures 30 and 50 to be in non-engaged disposition, they must be unconnected or unengaged one to the other. A form of non-engaged disposition is illustrated in FIG. 3, which shows a top view of the left front corner section of carton 12, with a portion of cover panel 71 cut away. In this non-engaged disposition, outer panel 31 and side wall panel 51 are upright. Front corner panel 52 is disposed approximately parallel to outer panel 31. And inner panel 32 is disposed approximately perpendicular to panel 31 and is overlying panel 52. This arrangement is also depicted in FIG. 4, which shows a side sectional view of closed carton 12 in non-engaged mode, taken along line 4—4 of FIG. 2. It is also depicted in FIG. 5, which shows a front sectional view of carton 12 in non-engaged mode, taken along line 5—5 of FIG. 2.

A unique aspect of the preferred embodiment is that in format #2 double-panel wall structure 30 is held in upright position by a frictional engagement between end edges 38 (of inner panel 32) and cover side flaps 72. In the drawings of FIGS. 3 and 5, a slight gap is shown between end edge 38 and cover side flap 72. This gap is provided so that those components can be easily identified. However, in actuality end edge 38 would be touching side flap 72, thereby creating the frictional engagement which holds wall structure 30 in upright position.

Figure 6:
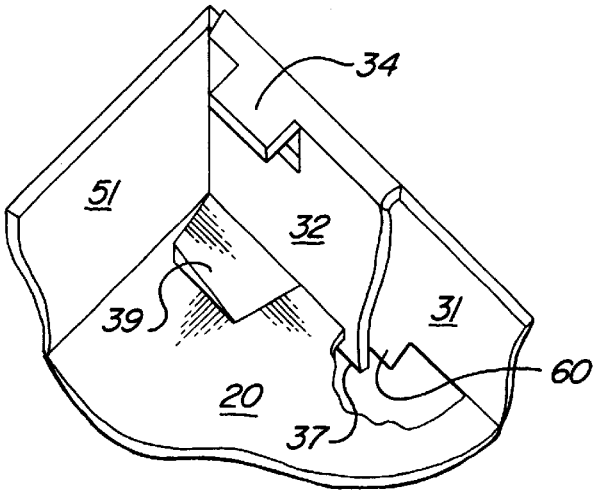
FIG. 6 is an inside perspective view of the right front corner section of an open carton showing the side wall and front wall structure in engaged disposition.

Format #3, the closed carton in engaged mode, is a carton with the cover in closed disposition and wall structures 30 and 50 in engaged disposition. (From external view such a carton would resemble that shown in FIG. 2.) For wall structures 30 and 50 to be in engaged disposition, they must be connected or engaged one to the other. Engaged disposition is illustrated in FIG. 6, which shows an inside perspective view of the right front corner section of carton 12 after front wall structure 30 and side wall structure 50 have been engaged. In this disposition, front corner panel 52 is enclosed between outer panel 31 and inner panel 32, and interlock portions 37 and hole-covering flaps 39 are engaged within a pair of openings 88 in the bottom of the box, thereby holding inner panel 32 in an upright position.

Figure 7:
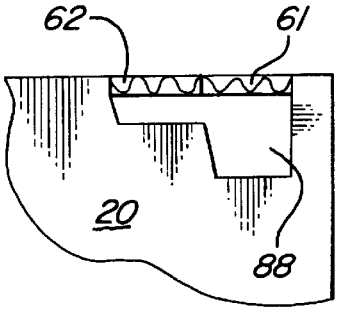
FIG. 7 is a bottom view of the right front corner section of the closed carton in non-engaged mode.
Figure 8:
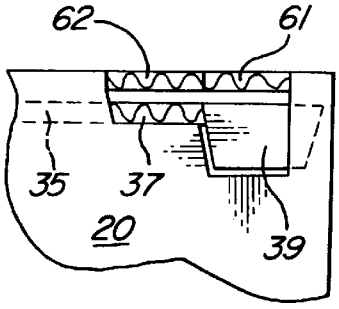
FIG. 8 is a bottom view of the right front corner section of the closed carton in engaged mode.

Opening 88 is the opening which results in the bottom of the box after thermal-leg 60 moves to upright or vertical position (resulting from erecting blank 10 into carton 12). As such, opening 88 is disposed between outer panel 31 and bottom panel 20. Opening 88 can be seen in FIG. 7 which shows a bottom view of the right front corner section of carton 12 in non-engaged mode and in FIG. 8 which shows the same corner section of carton 12 in engaged mode. For future reference, we could call opening 88 a "thermal-leg-created opening." (For clarity, the drawing of FIG. 8 shows a slight gap between flap 39 and bottom panel 20. However, in actuality there might be little or no gap between the rear edge of flap 39 and bottom panel 20.)

The structure and function of a hole-covering flap is discussed in my U.S. Pat. No. 5,961,035 (Designer Pizza Box with Enhancements). However, hole-covering flap 39 in the instant invention is an improvement over the flap shown in U.S. Pat. No. 5,961,035. Specifically, the shape and placement of hole-covering flap 39 is such that a portion of the flap is disposed outside opening 88, and thereby rests on top of panel 20, while another portion of flap 39 is disposed inside the opening. This arrangement is illustrated in FIGS. 6 and 8. What allows for this unique configuration is the resiliency or spring-back of the corrugated board, which pushes the downwardly-disposed portion of flap 39 downward and into opening 88.

The result of having (a portion of) flap 39 disposed inside opening 88 is that flap 39 not only covers (or fills) the opening but also serves the function of helping to hold inner panel 32 in upright (vertical) disposition, thereby serving as an inner panel interlock means. As such it's possible to eliminate interlock portion 37 and use hole-covering flap 39 as the exclusive inner panel interlock means for holding inner panel 32 in vertical position. If this is done, it may be advisable to widen hole-covering flap 39 to achieve optimum functionality of the flap and, accordingly, re-shape opening 88 (thermal-leg 60) to accept the widened flap 39.

Format #4, the open carton in non-engaged mode, is a carton with the cover in open disposition and wall structures 30 and 50 in non-engaged disposition. In essence, this is the carton of format #2 after cover 70 has been laid back. With the cover laid back, front wall structure 30 and side wall structures 50 move from an upright to a fall-back position due to the inherent resiliency or spring-back of the corrugated board. A carton that has been recently folded will exhibit greater spring-back than one that has been folded for longer time. FIG. 9 depicts a left front corner section of carton 12 in open disposition and non-engaged mode, in which wall structures 30 and 50 are in a fall-back position, or at an obtuse angle in relation to bottom panel 20. A unique feature of a carton in this format is that wall structures 30 and 50 are freely movable, meaning that they can move from an upright position to a horizontal position without having to first be disconnected from engagement to an adjacent wall structure. By being freely movable, structures 30 and 50 can move to a position that's coplanar to bottom panel 20. This feature makes it possible to easily cut a pizza with a rocker knife without bending or damaging the walls of the carton.

Format #5, the open carton in engaged mode, is a carton with the cover in open disposition and wall structures 30 and 50 in engaged disposition. In essence, this is the carton of format #4 after wall structures 30 and 50 have been engaged one to the other. FIG. 10 depicts the corner section shown in FIG. 9 after wall structures 30 and 50 have been engaged. In that disposition, front corner panel 52 is enclosed between outer panel 31 and inner panel 32 and panel 32 is locked in upright position (as depicted in FIG. 6).

Figure 12:
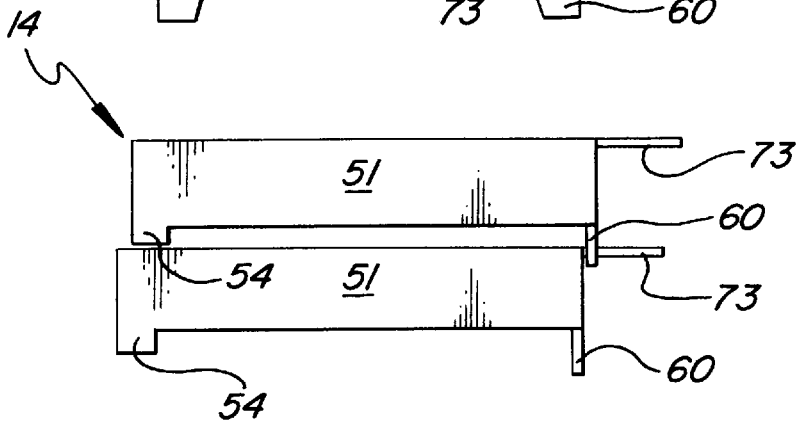
FIG. 12 is a left side elevation view of the stack of FIG. 11.

Format #6, the stack of topside up cartons, is two or more cartons disposed topside up and stacked one on the other. The cartons may be either or loaded with pizza. Of course pizza boxes have been stacked for decades. However, what makes this stack unique is that, there's a substantial air gap between the cartons due to the thermal-legs. When the stacked cartons contain pizza the cover of the bottom carton avoids becoming soggy because it's out of contact with the hot bottom panel of the top carton. Also, even though cover front flap 73 is allowed to project outward, or coplanar with cover panel 71, the cartons still stack relatively level (which would not occur with a conventional carton equipped with thermal-legs). FIG. 11 shows a front elevation view of a stack 14 and FIG. 12 shows a left side elevation view of the stack. (For clarity, the drawings show a small gap between the bottom edge of rear thermal-leg 54 and the cover panel of the carton below. However, in actuality the bottom edge of thermal-leg 54 would sit on the cover panel of the below carton.) What allows the cartons to stack relatively level is the unique structure of flap 73, or the fact that flap 73 is narrower than usual. This allows the long portion of thermal-legs 60 to be disposed to the outside of flap 73 and in front of, or on an exterior side of front wall structure 30, thereby allowing the cartons to stack relatively level. So bottom edge 61 of thermal-legs 60 is disposed lateral to cover front flap 73 while bottom edge 62 sits on top of flap 73.

Figure 13:
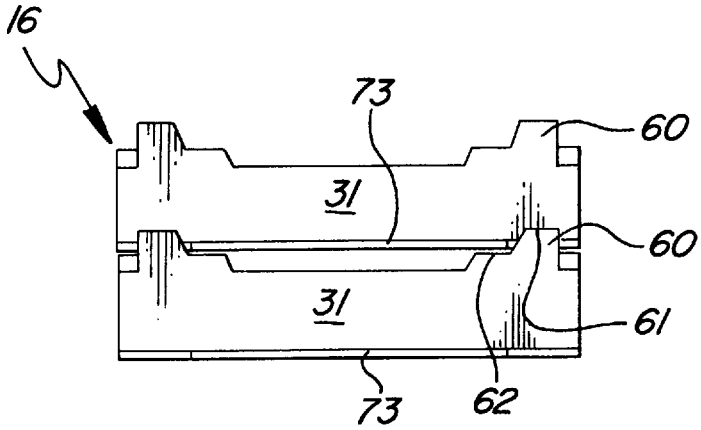
FIG. 13 is a front elevation view of a stack of two upside down cartons.
Figure 14:
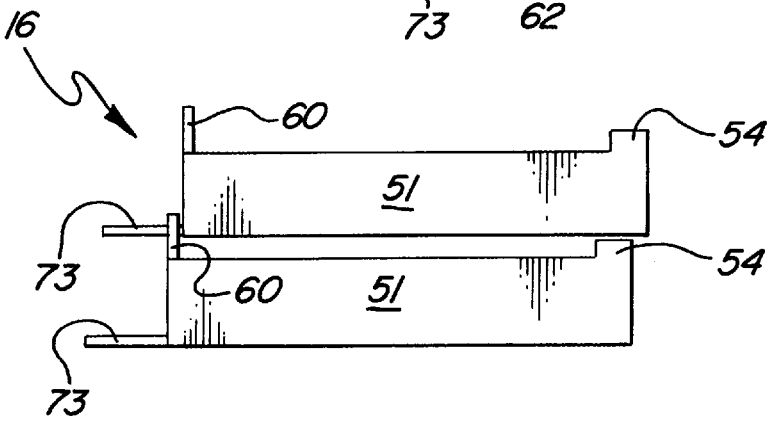
FIG. 14 is a right side elevation view of the stack of FIG. 13.

Format #7, the stack of upside down cartons, is two or more cartons disposed upside down and stacked one on the other. In essence, this is the stack of format #6 turned upside down. Format #6 works best when pulling boxes from the top of a stack; format #7 works best when pulling boxes from the bottom of a stack. FIG. 13 shows a front elevation view of an upside down stack 16 and FIG. 14 shows a right side elevation view of the stack.

In a closed carton loaded with hot pizza, thermal-legs 54 (disposed adjacent rear wall 40) and thermal-legs 60 (disposed adjacent front wall structure 30) play an important role by holding bottom panel 20 above the table top and, thereby, reducing loss of heat by conduction into the table top and also preventing condensation build-up on the table. Thermal-legs 54, 60 are best viewed in FIG. 2. In addition, a complete view of thermal-leg 54 can be seen in FIG. 15, which shows a right rear corner section of carton 12. Thermal-leg 54 projects below bottom panel 20 by a distance 80 and thermal-leg 60 projects below bottom panel 20 by a distance 81. It is noted that those distances are unequal and, specifically, distance 81 is substantially longer than distance 80. Further, distance 81 is at least ten millimeters. Those distances are referred to as the "heights" of the thermal-legs.

Operation of the Invention

Blank 10 can be erected into either a closed carton in engaged mode (format #3) or a closed carton in non-engaged mode (format #2). To create a closed carton in engaged mode, apply the following procedure. It is noted that this is a same procedure as used for erecting a standard square pizza box having a double-panel front wall. First, simultaneously fold both front corner panels 52 to upright position and then fold side wall panels 51 upward or to upright position. Second, fold outer panel 31 to upright position and then fold inner panel 32 downward until interlock portions 37 and hole-covering flaps 39 engage with openings 88. Third, push both rear corner panels 53 inward. Finally, pull cover 70 forward and simultaneously fold cover side flaps 72 inside the box, and finish closing the cover.

At this point, cover front flap 73 will be coplanar with cover panel 71 and overlapping front wall structure 30. This is the format that many pizza operators prefer for stacking boxes because the projecting cover front flap provides an easy means for grasping the box and pulling it from a stack. This format is shown in FIGS. 2, 3, 4, and 11–14. However, an alternate configuration for stacking closed boxes is with the cover front flap folded inside the box cavity. This can be done, as well, if desired. Finally, after the pizza is loaded into the box, the cover front flap should be tucked into the box cavity.

To erect blank 10 into a closed carton in non-engaged mode, apply the following procedure. First, position the blank so that it's horizontal and with the inside surface up and front wall structure 30 next to your abdomen. Second, with your hands placed near the rear end of side wall panels 51, simultaneously fold side wall panels 51 upward and then, with your index fingers, fold rear corner panels 53 inward. Third, keeping you hands in that position, fold rear wall 40 upright using your fingers. Fourth, still keeping your hands in that position, fold cover panel 71 downward to about half way closed. Fifth, fold cover side flaps 72 inward and then finish closing the cover. Sixth, turn the box to upright position with front wall structure 30 up. Seventh, open cover panel 71 about three inches and then simultaneously fold front corner panels 52 inward. Eighth, fold outer panel 31 upright and then fold inner panel 32 inward until it's perpendicular to panel 31. Finally, close cover 70 onto the box, while leaving cover front flap 73 to extend outward. In closing the cover, cover side flaps 72 will slide between end edges 38 of inner panel 32 and side wall panels 51. A frictional engagement will occur between cover side flaps 72 and inner panel 32, which will hold front wall structure 30 in upright position. The end result is a carton in format #2, a closed carton in non-engaged mode (see FIG. 3 for an illustration of the wall structures configuration).

If wall structure 30 does not stay in upright position, the carton must be re-designed to create a tighter frictional engagement. This can be accomplished by slightly widening inner panel 32 or, in other words, creating a slightly longer distance between end edges 38. Conversely, if the frictional engagement is too tight, which could result in difficulty closing the cover, the distance between end edges 38 must be slightly shortened.

The advantage of format #2 is that it allows a pizza to be easily cut in the box with a rocker knife without bending or deforming any of the carton walls. To do that, first open the non-engaged carton. As this is done, wall structures 30 and 50 will fall outward. The result is a carton in format #4, an open carton in non-engaged mode (FIG. 9). Second, place a pizza on bottom panel 20 and then cut it with a rocker knife or any other tool of your choice. Third, engage the carton wall structures by folding side wall structures 50 to upright position, folding outer panel 31 upward and, finally, folding inner panel 32 downward until interlock portions 37 and hole-covering flaps 39 engage with openings 88. The result is a carton in format #5, an open carton in engaged mode (see FIGS. 6, 10 for an illustration of enagaged wall structures configuration). Finally, close cover 70 onto the carton, including folding cover front flap 73 inside the box cavity. This results in a carton in format #3, a closed carton in engaged mode. With flap 73 inside the box cavity, it fits between tabs 34, which helps prevent cover 70 from shifting side-to-side. Further discussion of the function of cover anti-shift tabs can be found in my U.S. patent application Ser. No. 09/394,784 (Quality-enhancing Pizza Carton).

To facilitate easy closure of front wall structure 30, it might be necessary to position the pizza slightly rearward for cutting and then, after structure 30 has been erected and engaged with wall structures 50, slide the pizza forward with a short, quick rearward movement of the box. To enable inner panel 32 to clear the pizza as the panel is being pushed downward, the inwardly-disposed portion 36 has been incorporated into the outer edge of inner panel 32. If necessary, inwardly-disposed portion 36 can be made wider than that shown in the drawings.

Within the drawings, a fold line between component parts of the invention is depicted with a dashed line. Within the context of this invention, a fold line can be created by a number of means such as, for example, by a crease or score in the board, by a series of aligned spaced short slits in the board, and by a combination of aligned spaced short and long slits. In some cases, when a longer slit is bounded on the ends by a series of shorter slits or a score, the longer slit may be slightly offset in alignment from the shorter slits or score for the purpose of creating a slot along the fold line when the blank is set up into a box. Such an offset slit may be referred to herein as a "slot-forming slit." Nonetheless, the entire combination of long and short slits is considered to constitute a single fold line unless otherwise indicated.

In addition, to create a fold line where one panel is folded 180° to lay parallel on another panel, the fold line may constitute two narrowly-spaced parallel scores or series of aligned slits. In this case, the two narrowly-spaced parallel scores or series of aligned slits constitute a single fold line unless otherwise indicated. In conclusion, as referred to herein, a fold line is any line between two points on the blank or box along which the board is intended to be folded when the blank is being erected into a box. The type of fold lines shown in the drawings are presently preferred but it will be appreciated that other methods known to those skilled in the art may be used.

CONCLUSION, RAMIFICATIONS, AND SCOPE

I have disclosed a versatile, quality-enhancing carton having:

(a) engageable wall structures that are disposed in a non-engaged format even though the carton is in erected disposition;

(b) thermal-legs of unique structure;

(c) a hole-covering flap attached to the inner panel of a double-panel wall, the hole-covering flap performing the dual functions of (a) covering an opening in the bottom of the box and (b) holding the inner panel of the double-panel wall in engaged or upright mode (the opening being typically created from formation of a thermal-leg that's adjacent the double-panel wall);

(d) a reduced-width cover front flap, thereby enabling multiple thermal-leg-equipped cartons to be stacked relatively level when the cover front flap is projecting forward.

The illustrated number, size, shape, type, and placement of components represent the preferred embodiment; however, many other combinations and configurations are possible within the scope of the invention. Following are three examples of possible modifications upon the invention.

A first possible modification is to eliminate interlock portions 37 and use hole-covering flaps 39 as the exclusive inner panel interlock means.

A second possible modification is to convert side wall panels 51 into "limited fall-back walls." Explanation of the structure and function of fall-back side walls can be found in my U.S. Pat. No. 5,833,130 (Multi-function Pizza Carton) and in my U.S. Pat. No. 5,881,948 (Expandable Pizza Box and Method of Use).

A third possible modification is to install one or more rear thermal-legs projecting downward from rear wall 40. If this were done, it could be advisable to omit thermal-legs 54.

The foregoing discussion has pertained mainly to packaging relatively flat food products such as pizza. However, it should be realized that my invention could be used for other purposes, as well. In conclusion, it is understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

I claim:

1. A closed, wall-engageable carton disposed in a non-engaged mode and comprising:

a bottom panel, a cover disposed in a closed position, a plurality of wall structures including:

(a) a rear wall, and (b) adjacent first and second wall structures capable of being engaged one to the other;

wherein said first and second wall structures are in a non-engaged disposition, whereby when said cover is moved to an open position both of said first and second wall structures are freely movable from an upright position to a horizontal position and, optionally, said first and second wall structures can be put into an engaged disposition to create upright-sustaining walls on said carton.

2. The carton of claim 1 wherein:

said first wall structure is a double-panel wall structure comprising an outer panel hingedly attached at a bottom edge to said bottom panel and an inner panel hingedly linked to a top edge of said outer panel and having at least one inner panel interlock means disposed along an outer edge, said second wall structure comprises a wall panel hingedly attached to said bottom panel and a corner panel disposed approximately parallel to said outer panel, said carton further comprises at least one opening disposed between said outer panel and said bottom panel, said at least one opening being capable of receiving said at least one inner panel interlock means;

wherein said at least one inner panel interlock means is free of engagement with said at least one opening.

3. The carton of claim 1 wherein:

said first wall structure is a double-panel front wall structure opposing said rear wall and comprising an outer panel hingedly attached at a bottom edge to said bottom panel and an inner panel hingedly linked to a top edge of said outer panel and having an outer edge, said second wall structure comprises a first side wall panel hingedly attached to said bottom panel and a first free-swinging corner panel disposed approximately parallel to said outer panel, said plurality of wall structures further includes a third wall structure opposing said second wall structure and comprising a second side wall panel hingedly attached to said bottom panel and a second free-swinging corner panel disposed approximately parallel to said outer panel, said cover comprises a cover panel and opposing first and second cover side flaps disposed between said inner panel and said first and second side wall panels, respectively;

wherein a frictional engagement exists between said first and second cover side flaps and respective first and second end edges of said inner panel, whereby said first wall structure is held in an upright disposition because of said frictional engagement.

4. The carton of claim 3 wherein:

the outer edge of said inner panel has an inwardly-disposed portion.

5. The carton of claim 3 further comprising:

a plurality of thermal-legs including at least one thermal-leg projecting below said bottom panel by a distance of at least ten millimeters.

6. The carton of claim 5 wherein:

said first wall structure further comprises a hole-covering flap attached to the outer edge of said inner panel.

7. The carton of claim 6 wherein:

said hole-covering flap is an inner panel interlock means, whereby when said inner panel is folded to an approximately parallel position in relation to said outer panel said inner panel interlock means engages with an opening disposed between said outer panel and said bottom panel and, thereby, holds said inner panel in said approximately parallel position.

8. The carton of claim 6 wherein:

said carton is a pizza carton.

9. A carton having a hole-covering flap and comprising:

a bottom panel, a double-panel wall structure comprising an outer panel attached to said bottom panel and an inner panel hingedly linked to a top edge of said outer panel and disposed approximately parallel to said outer panel, said inner panel having a hole-covering flap attached to an outer edge and disposed approximately perpendicular to said inner panel, an opening disposed between said outer panel and said bottom panel, said hole-covering flap covering at least a portion of said opening;

wherein said hole-covering flap is partially disposed above said bottom panel and partially disposed within said opening.

10. A carton having at least two thermal-legs and comprising:

a bottom panel, a rear wall, a front wall structure, a cover hingedly attached to said rear wall, a plurality of thermal-legs including a first thermal-leg disposed adjacent said front wall structure and a second thermal-leg disposed adjacent said rear wall, said first and second thermal-legs projecting below said bottom panel by respective first and second predetermined distances;

wherein said first and second predetermined distances are unequal.

11. The carton of claim 10 wherein:

said carton is a pizza carton and said first predetermined distance is longer than said second predetermined distance.

12. First and second thermal-leg-equipped cartons disposed topside up, the first carton sitting on top of the second carton, each of the cartons being of foldable material and comprising:

a bottom panel, a plurality of wall structures including a rear wall and a front wall structure, a cover comprising a cover panel attached to said rear wall and at least one cover front flap attached to said cover panel, said at least one cover front flap overhanging said front wall structure and being disposed approximately coplanar to said cover panel, a plurality of thermal-legs including a first thermal-leg disposed adjacent said front wall structure;

wherein a portion of the first thermal-leg of said first carton is disposed in front of the front wall structure of said second carton.

13. The first and second cartons of claim 12, wherein in each of the cartons:

said front wall structure is a double-panel wall structure, said plurality of wall structures further includes a side wall structure adjacent said front wall structure, said side wall structure and said front wall structure being capable of being engaged one to the other;

wherein said side wall structure and said front wall structure are in a non-engaged disposition.

14. The first and second cartons of claim 12, wherein in each of the cartons:

a portion of a bottom edge of the first thermal-leg of said first carton sits on the cover front flap of said second carton.

15. The first and second cartons of claim 12, wherein in each of the cartons:

said plurality of thermal-legs further includes a second thermal-leg disposed adjacent said rear wall;

wherein at least a portion of a bottom edge of the second thermal-leg of said first carton sits on the cover panel of said second carton.

16. First and second thermal-leg-equipped cartons disposed upside down, the first carton being underneath the second carton, each of the cartons being of foldable material and comprising:

a bottom panel, a plurality of wall structures including a rear wall and a front wall structure, a cover comprising a cover panel attached to said rear wall and at least one cover front flap attached to said cover panel, said at least one cover front flap underlying said front wall structure and being disposed approximately coplanar to said cover panel, a plurality of thermal-legs including a first thermal-leg disposed adjacent said front wall structure;

wherein a portion of the first thermal-leg of said first carton is disposed in front of the front wall structure of said second carton.

17. The first and second cartons of claim 16, wherein in each of the cartons:

said front wall structure is a double-panel wall structure, said plurality of wall structures further includes a side wall structure adjacent said front wall structure, said side wall structure and said front wall structure being capable of being engaged one to the other;

wherein said side wall structure and said front wall structure are in a non-engaged disposition.

18. The first and second cartons of claim 16, wherein in each of the cartons:

the cover front flap of the second carton sits on a portion of a bottom edge of the first thermal-leg of the first carton.

19. The first and second cartons of claim 16, wherein in each of the cartons:

said plurality of thermal-legs further includes a second thermal-leg disposed adjacent said rear wall;

wherein the cover panel of said second carton sits on at least a portion of a bottom edge of the second thermal-leg of said first carton.

20. First and second thermal-leg-equipped cartons disposed topside up, the first carton sitting on top of the second carton, each of the cartons being of foldable material and comprising:

a bottom panel, a plurality of wall structures including a rear wall, a side wall, and a front wall structure, a cover, a first thermal-leg having a height of at least ten millimeters;

wherein at least a portion of a bottom edge of the first thermal-leg of said first carton sits on the cover of said second carton, whereby a substantial air gap is created between the bottom panel of said first carton and the cover of said second carton.

21. The first and second cartons of claim 20 wherein:

each of the cartons contains a pizza.

22. The first and second cartons of claim 20 wherein:

each of the cartons is a pizza carton and in each of the cartons said first thermal-leg is disposed adjacent said rear wall.

23. The first and second cartons of claim 20 wherein:

each of the cartons is a pizza carton and in each of the cartons said first thermal-leg is disposed adjacent said front wall structure.

24. The first and second cartons of claim 20 wherein:

each of the cartons is a pizza carton and in each of the cartons at least a portion of said first thermal-leg projects from said side wall.

25. The first and second cartons of claim 20 wherein:

each of the cartons is a pizza carton and in each of the cartons at least a portion of said first thermal-leg projects from a corner panel attached to an end of said side wall.

26. The first and second cartons of claim 20 wherein:

each of the cartons is a pizza carton and in each of the cartons said first thermal-leg projects from said front wall.

27. The first and second cartons of claim 20 wherein:

each of the cartons is a pizza carton;

each of the cartons further comprises a second thermal-leg;

wherein at least a portion of the second thermal-leg of said first carton is disposed on an exterior side of one of the plurality of wall structures of said second carton.

28. First and second thermal-leg-equipped pizza cartons disposed topside up, the first carton sitting on top of the second carton, each of the cartons being of foldable material and comprising:

a bottom panel, a plurality of wall structures including a rear wall, a side wall, and a front wall structure, a cover comprising a cover panel, a plurality of thermal-legs including first and second thermal-legs, at least one of said plurality of thermal-legs having a height of at least ten millimeters;

wherein at least a portion of the first thermal-leg of said first carton is disposed on an exterior side of one of the plurality of wall structures of said second carton and at least a portion of a bottom edge of the second thermal-leg of said first cartons its on the cover of said second carton.

29. The first and second cartons of claim 28 wherein:

said one of the plurality of wall structures of said second carton is the front wall structure.

30. First and second thermal-leg-equipped cartons disposed upside down, the first carton being underneath the second carton, each of the cartons being of foldable material and comprising:

a bottom panel, a plurality of wall structures including a rear wall, a side wall, and a front wall structure, a cover comprising a cover panel, a plurality of thermal-legs extending upwardly from said bottom panel and including a first thermal-leg, at least one of said plurality of thermal-legs having a height of at least ten millimeters;

wherein at least a portion of the first thermal-leg of said first carton is disposed on an exterior side of one of the plurality of wall structures of said second carton.

* * * * *

UNITED STATES PATENT AND TRADEMARK OFFICE

CERTIFICATE OF CORRECTION

PATENT NO. : 6,290,122 B1
DATED : September 18, 2001
INVENTOR(S) : John D. Correll It is certified that error appears in the above-identified patent and that said Letters Patent is hereby corrected as shown below:

Column 8,
Line 1, insert -- empty -- after "either."

Column 15,
Line 3, delete "cartons its" and substitute -- carton sits --.

Signed and Sealed this

Thirtieth Day of April, 2002

*Attest:*

*Attesting Officer*

JAMES E. ROGAN
*Director of the United States Patent and Trademark Office*